US010981285B2

(12) United States Patent
Howell et al.

(10) Patent No.: US 10,981,285 B2
(45) Date of Patent: Apr. 20, 2021

(54) HAIR CLIPPER OPERATING SWITCH WITH RESET FUNCTION

(71) Applicant: LISTER SHEARING EQUIPMENT LIMITED, Stonehouse (GB)

(72) Inventors: Robin James Howell, Cheltenham (GB); David Alexander Pyrah, Yate (GB)

(73) Assignee: LISTER SHEARING EQUIPMENT LIMITED, Stonehouse (GB)

( * ) Notice: Subject to any disclaimer, the term of this patent is extended or adjusted under 35 U.S.C. 154(b) by 0 days.

(21) Appl. No.: 16/394,826

(22) Filed: Apr. 25, 2019

(65) Prior Publication Data

US 2019/0329432 A1 Oct. 31, 2019

(30) Foreign Application Priority Data

Apr. 30, 2018 (GB) ..... 1807005.2

(51) Int. Cl.
*B26B 19/38* (2006.01)
*B26B 19/24* (2006.01)
*B26B 19/04* (2006.01)

(52) U.S. Cl.
CPC ..... *B26B 19/3886* (2013.01); *B26B 19/046* (2013.01); *B26B 19/24* (2013.01); *B26B 19/3873* (2013.01)

(58) Field of Classification Search
CPC ..... B26B 19/3886; B26B 19/3873; B26B 19/046; B26B 19/24
USPC ..... 30/210
See application file for complete search history.

(56) References Cited

U.S. PATENT DOCUMENTS 3,215,894 A * 11/1965 Haussermann ..... B26B 19/388 361/30
4,384,180 A * 5/1983 Meijer ..... B26B 19/14 200/308
4,581,822 A 4/1986 Fujimura
4,882,458 A * 11/1989 Berg ..... H01H 3/20 200/52 R
5,050,304 A 9/1991 Fujikawa et al.
2003/0131480 A1* 7/2003 Leung ..... B26B 19/3886 30/210

(Continued)

FOREIGN PATENT DOCUMENTS

CN 2266485 Y 11/1997
CN 204585270 U 8/2015

(Continued)

OTHER PUBLICATIONS

English translation of DE 2436276, patent date: Feb. 12, 1976.*

(Continued)

*Primary Examiner* — Hwei-Siu C Payer
(74) *Attorney, Agent, or Firm* — Greer, Burns & Crain, Ltd.

(57) ABSTRACT

An electrically operable clipper has a body portion and a head portion, wherein the head portion includes a movable cutter and a fixed comb. The clipper includes an internally located electric motor operable to move the movable cutter. The clipper further includes an operating switch movable between an off position, an operating position and a reset position, wherein the reset position operates a motor reset module of the clipper.

18 Claims, 7 Drawing Sheets

(56) References Cited

U.S. PATENT DOCUMENTS

2019/0321994 A1* 10/2019 Jacobowitz ..... B26B 19/3886
2019/0329432 A1* 10/2019 Howell ..... B26B 19/3886

FOREIGN PATENT DOCUMENTS

DE 2436276 A1 2/1976
GB 2573289 A * 11/2019

OTHER PUBLICATIONS

Extended European Search Report from corresponding European Patent Application No. 19170747.0, dated Sep. 25, 2019.
United Kingdom Search Report from United Kingdom Patent Application No. GB1807005.2, dated Oct. 24, 2018.

* cited by examiner

HAIR CLIPPER OPERATING SWITCH WITH RESET FUNCTION

BACKGROUND

The present invention relates to an electrically operable clipper and more particularly to an electrically operable animal hair clipper.

Electrically operable clippers may be used to cut hair from the coats of animals. Such clippers typically have a handle by which a user is able to grip the clipper, a fixed comb and a movable clipper blade. The clipper blade is movable across the comb in a reciprocating manner by an electric motor provided within the handle. A transmission arrangement is provided between the output shaft of the motor and the clipper blade in order to convert the rotary motion of the output shaft to the aforementioned reciprocating motion of the clipper blade.

SUMMARY

According to the present invention there is provided an electrically operable clipper having a body portion and a head portion, wherein the head portion includes a movable cutter and a fixed comb, the clipper including an internally located electric motor operable to move the movable cutter, wherein the clipper includes an operating switch movable between an off position, an operating position and a reset position, wherein the reset position operates a motor reset module of the clipper.

The present invention thus utilises a single switch to both operate the electric motor and to reset the electric motor in the event that a motor cut-out event occurs. The present invention thus removes the need for a separate reset switch or button to be provided on the clipper.

Movement of the operating switch from the off position to the operating position may require movement of the switch in a first direction, and movement of the operating switch from the off position to the reset position may require movement of the switch in a second direction. In one embodiment of the invention the first direction may be opposite to the second direction.

By providing the reset position of the operating switch in a different direction to the operating position, then in advertent operation of the motor reset is avoided.

The switch may be biased from the reset position to the off position. This ensures that once a reset operation has been made, then the switch returns to a position ready for the next operation of the clipper.

The switch may be movable to a further operating position, wherein the operating position corresponds to a first operating speed of the electric motor and the further operating position may correspond to a second operating speed of the electric motor.

The operating switch may include an internal member and an external member joined to the internal member, where in the internal member is joined to the external member through a slot of the body portion. The internal and external members may, for example, be clipped together, joined by adhesive or connected by one or more mechanical fasteners.

The internal member may include a pair of resilient arms which co-operate with opposed ramp formations of the body portion. The co-operation of the arms with the ramp formations defines a detent mechanism of the operating switch.

The opposed ramp formations each comprise a plurality of inclined surfaces defining a plurality of peaks and troughs. the off position and the or each operating position of the switch are defined by opposing troughs of the opposed ramp formations. In the reset position, the resilient arms are compressed between facing inclined surfaces of the opposed ramp formations.

The internal member of the switch may include an abutment surface which contacts the motor reset module when the switch is in the reset position. The abutment surface may be located between the resilient arms.

BRIEF DESCRIPTION OF THE DRAWINGS

An embodiment of the present invention will now be described with reference to the accompanying drawings in which.

DETAILED DESCRIPTION

Figure 1:
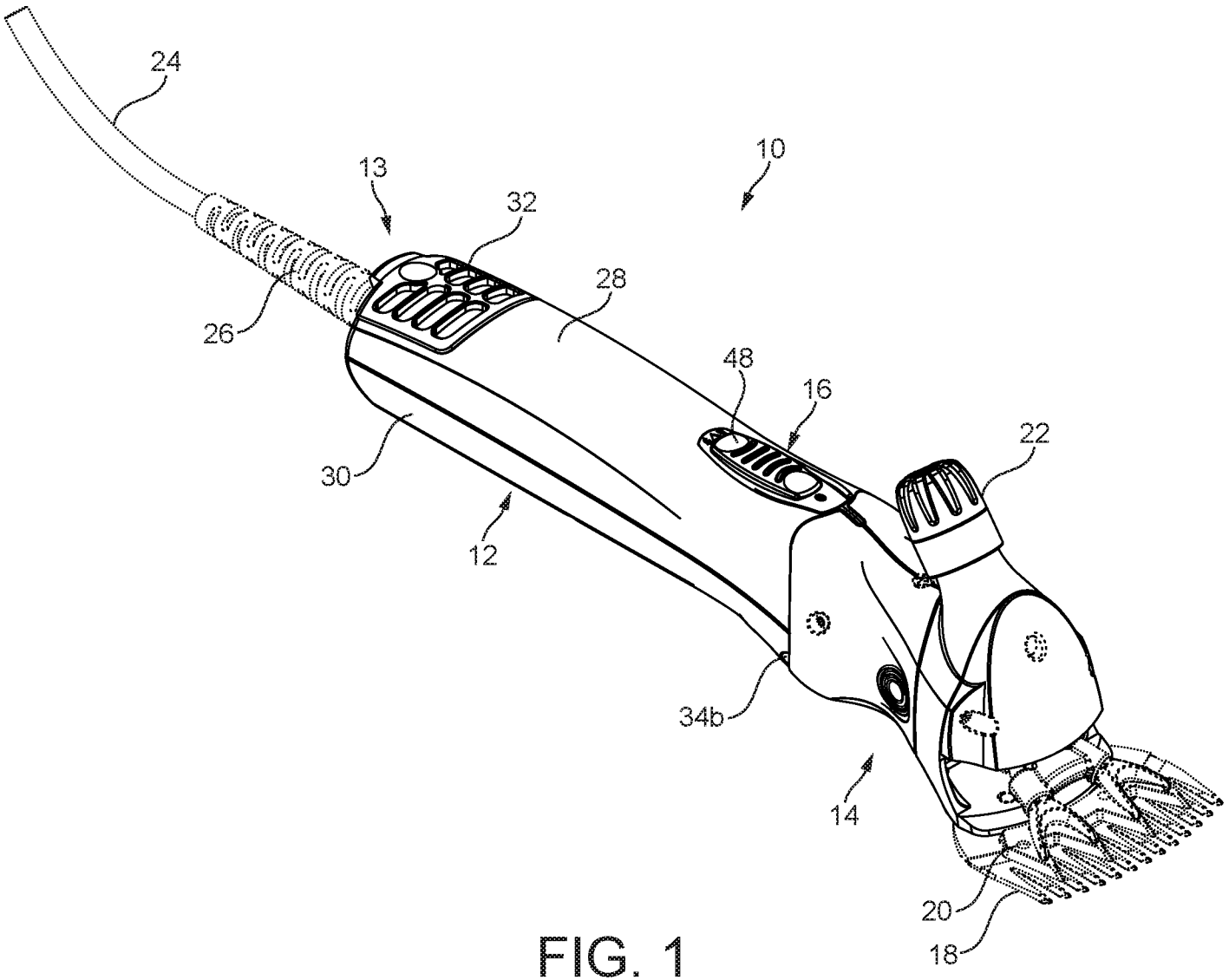
FIG. 1 shows a perspective view of a clipper in accordance with the present invention.
Figure 2:
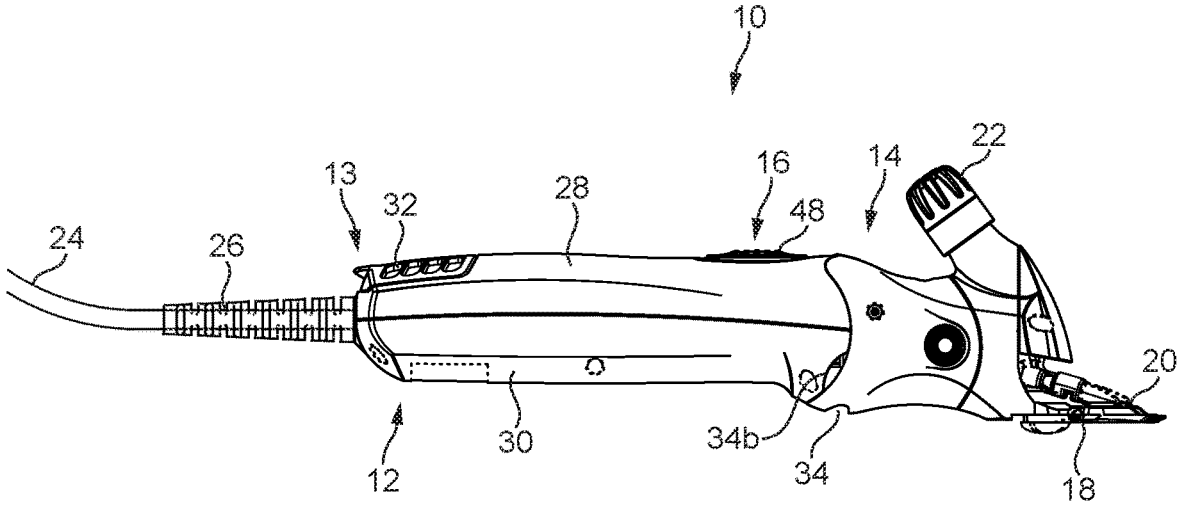
FIG. 2 shows a side view of the clipper.
Figure 3:
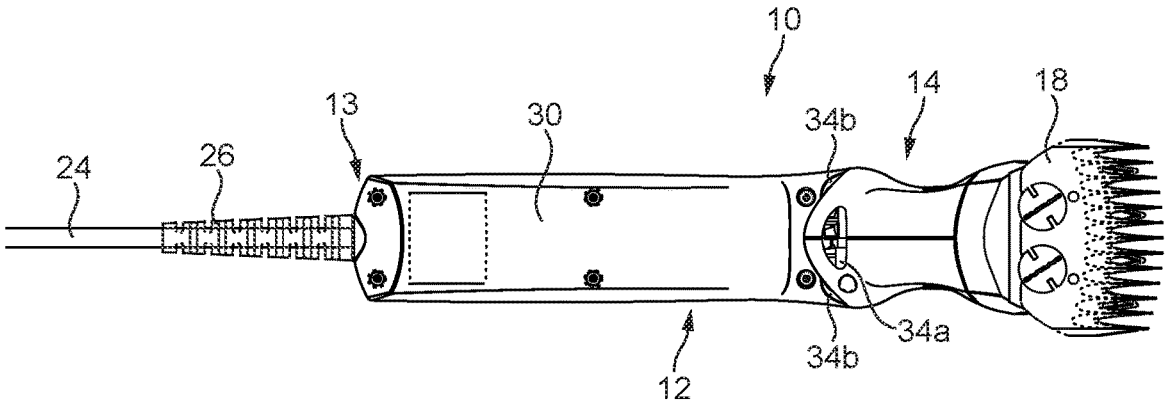
FIG. 3 shows a bottom plan view of the clipper.
Figure 4:
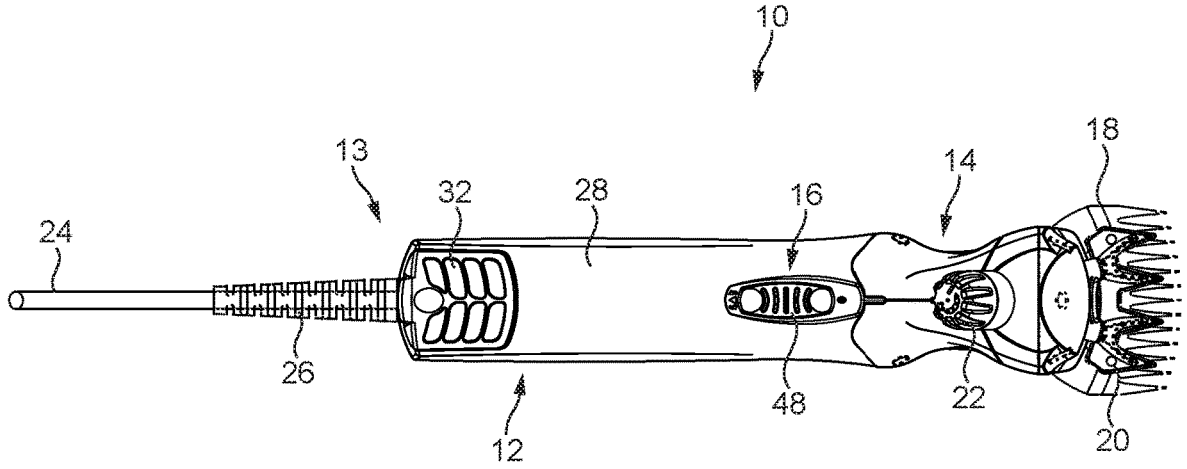
FIG. 4 shows a top plan view of the clipper.

Referring firstly to FIGS. 1 to 4, there is shown a handheld clipper generally designated 10. The clipper 10 is configured for the cutting of the hair of animals, for example bovine and ovine hair.

The clipper 10 comprises a body portion 12 and head portion 14. The body portion 12 is intended to be gripped by the hand of a user of the clipper 10 and is provided with a slidable switch 16. The switch 16 is positioned and configured such that it can be manipulated by the thumb of a user while gripping the clipper 10 in one hand.

The head portion 14 of the clipper 10 includes a fixed comb 18 and a movable cutter 20. The cutter 20 is movable in an arc across the comb 18 in a reciprocating manner by a drive mechanism of the clipper 10. The head portion 14 further includes a tension nut 22 which can be manipulated by a user of the clipper 10 to vary the contact pressure between the cutter 20 and the comb 18. In an alternative embodiment, not shown, the cutter 20 may be configured to move linearly over the comb 18 in a side to side reciprocating manner.

The clipper 10 is electrically powered and is provided with a power cable 24 which extends from an end of the body portion 12 which is distal to the head portion 14, hereinafter referred to as the distal end 13 of the body portion 12. A cable support 26 which prevents kinking of the cable 24 is provided at the location where the cable 24 enters the body portion.

The body portion 12 of the clipper 10 includes upper and lower casing halves 28, 30 which are, in use, connected to one another. The casing halves 28,30 may be formed from plastic, for example by injection moulding. The upper casing half 28 includes the slidable switch 16 and a plurality of inlet apertures 32. The inlet apertures 32 are provided at the end of the upper casing half 28 which is distal to the head portion. In the embodiment shown the upper casing half 28 is provided with eight inlet apertures 32. It will be appreciated that a greater or lesser number of inlet apertures 32 may be provided. Although not shown, the inlet apertures 32 are covered by a mesh panel located to the interior of the body portion 12 which acts to prevent the ingress of dust and debris such as animal hair clippings.

The head portion 14 is further provided with outlet apertures 34*a*,34*b*. A first outlet aperture 24*a* is provided to the underside of the clipper 10, which is to say the side of the clipper 10 opposite to that which has the inlet apertures 32. In the embodiment shown the outlet aperture 34 is semi-circular. It will be understood that the outlet aperture 34 may have alternative shapes. Two smaller outlet apertures 34*b* are provided on opposing sides of the clipper 10 at the interface of the body portion 12 to the head portion 14.

Figure 5:
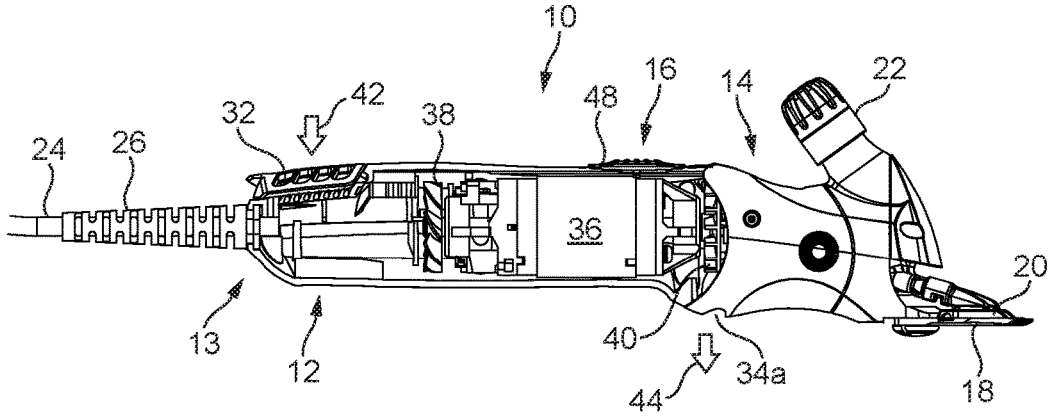
FIG. 5 shows a partially cutaway side view of the clipper.
Figure 6:
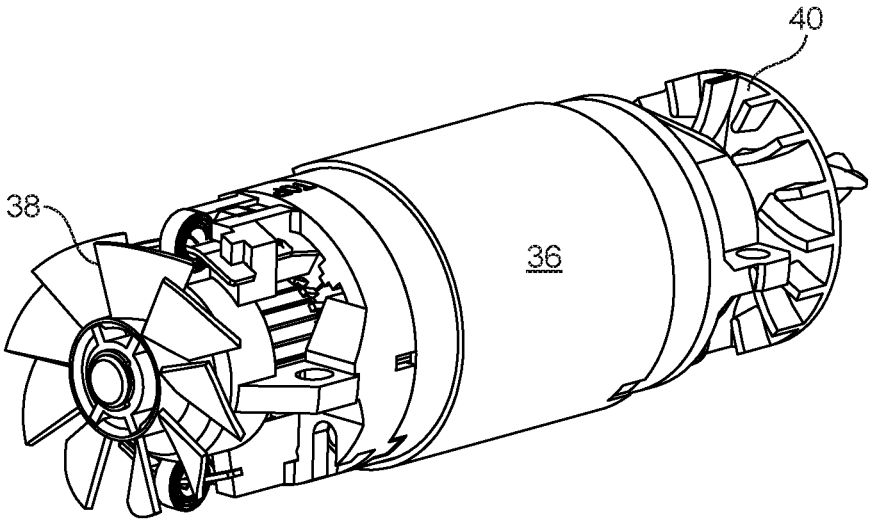
FIG. 6 shows a perspective view of a motor of the clipper.

Referring now to FIGS. 5 and 6, the internal configuration of the body portion 12 of the clipper 10 may be seen. The body portion 12 includes a longitudinally aligned electric motor 36. The electric motor 36 includes an output shaft (not shown) which extends into the head portion 14 and, in use, operates the aforementioned drive mechanism to move the cutter 20 across the comb 18.

The motor 36 is provided at opposite ends with a fan member 38,40. Each fan member 38,40 is connected to a shaft of the electric motor such that each fan member 38, 40 is rotated when the motor 36 is operated. Each fan member 38,40 is provided with a plurality of blades.

The fan member 38 located at the end of the motor 36 which is distal to the head portion 14 (hereinafter referred to as the distal fan member 38) is configured as an axial flow fan. In use, rotation of the distal fan member 38 causes air to be drawn into the body portion 12 through the inlet apertures 32 as indicated by arrow 42. Air which has been drawn into the body portion 12 in the manner described is then urged by the distal fan member 38 over and through the electric motor 36 in the direction of the head portion 14. In the embodiment shown, the distal fan member 38 is offset longitudinally within the body portion 12 with respect to the inlet apertures 32.

The fan member 40 located at the end of the motor 36 which is proximal to the head portion 14 (hereinafter referred to as the proximal fan member 40) is configured as a radial flow fan. In use, rotation of the proximal fan member 40 causes air to be ejected from the interior of the body portion 12 through the outlet aperture 34 provided in the head portion 14 as indicated by arrow 44. In the embodiment shown the outlet aperture 34 is aligned radially with respect to the proximal fan member 40.

In use, and as noted above, operation of the electric motor 36 results in rotation of both fan members 38,40. Air is drawn into the body member 12 via the inlet apertures 32 and directed over and through the electric motor 36. Air that has passed over and through the electric motor 36 is entrained by the proximal fan member 40 and ejected from the interior of the body portion 12 through the outlet aperture 34. The flow of air into, through and out of the body portion 12 serves to cool the electric motor 36. This improves the efficiency of the motor 36 and can further increase the service life of the electric motor 36. The aforementioned flow of air further acts to prevent heating of the exterior surface of the body portion 12 which can cause discomfort to the user during extended use of the clipper 10.

As noted above, the clipper 10 is provided with a slidable switch 16. The slidable switch 16 is operable to activate and deactivate the electric motor 36. The switch is movable in a longitudinal direction between an off position, a first operating position and a second operating position. The first and second operating positions correspond to first and second operating speeds of the electric motor, where the second operating speed is greater than the first operating speed. As will be described in greater detail below, the switch 36 is also longitudinally movable to a reset position where an internal reset module 46 of the clipper 10 is operated. The reset module 46 is provided to re-enable operation of the motor 36 after a motor cut-out event has occurred. The clipper 10 is provided with a motor cut-out mechanism to prevent damage to the motor 36 by, for example, a power surge, overheating, jamming of the comb 18 and cutter 20 or other such event outside of the normal operating parameters of the clipper 10.

FIGS. 7 to 17 illustrate the configuration of the slidable switch 16 and reset module 46. Looking firstly at FIGS. 15 to 17, the switch 16 includes an external member 48 and an internal member 50. The external member 48, as noted above, is configured such that it can be manipulated by the thumb of a user while gripping the clipper 10 in one hand. For this purpose, the external member 48 is provided with a plurality of ridges 52 which are arranged substantially transverse to the longitudinal form of the body portion 12. The external member 48 is formed from plastic, for example by injection moulding.

The external member 48 is provided with a connector portions 52 which connect the external member 48 to the internal member 50. In the embodiment shown, the connector portions 53 comprise arms which connect to a complementarily shaped location on the internal member 50.

The internal member 50 has a length that is greater than the length of the external member 48. The internal member 50 has a first end 54 to which the external member 48 is attached, and a second end 56 having a spaced pair of arms 58 and an abutment surface 60 positioned between the arms 58. The abutment surface 60, in use, is configured to abut an actuation member 62 of a reset module 46 as will be described in greater detail below. The internal member 50 is further provided with a guide surface 64 which, in use, lies against a surface 66 of the reset module 46.

The internal member 50 is formed from plastic, for example by injection moulding. The arms 58 of the internal member 50 are provided with rounded ends 68 which, in use, interact with opposed ramp formations 70 of the upper casing half 28 to provide a detent mechanism of the switch 16.

Figure 7:
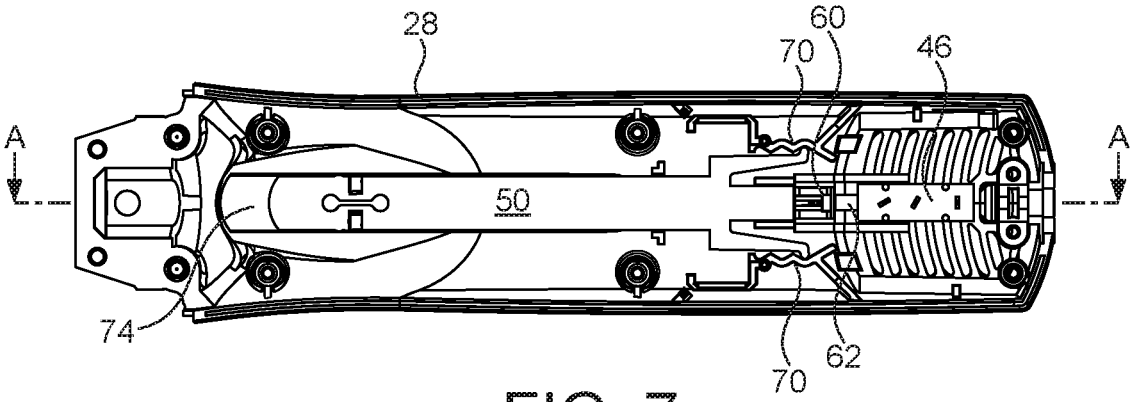
FIG. 7 shows a bottom plan view of the interior of a portion of the handle of the clipper.
Figure 8:
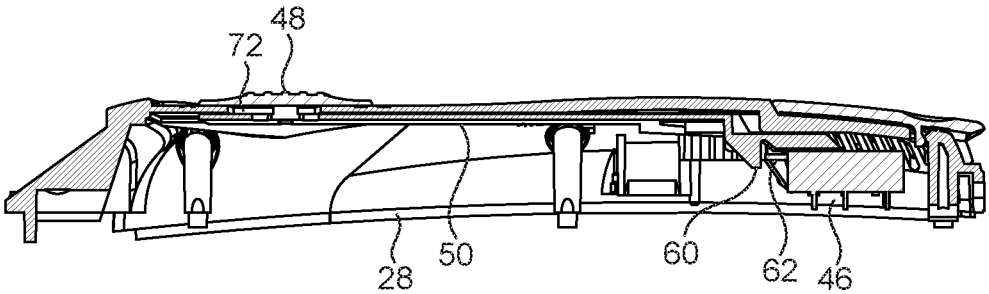
FIG. 8 shows a sectional view indicated by arrows A-A on FIG. 7.
Figure 9:
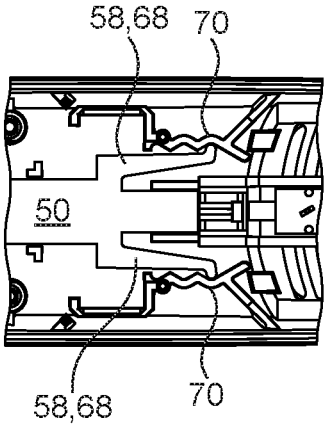
FIGS. 9 to 14 show bottom plan views of the interaction of switch detent mechanism of the clipper.
Figure 10:
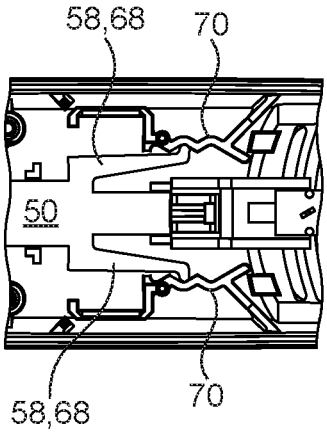

Referring now to FIGS. 7 and 8 the arrangement of the switch 16, upper casing half 28 and reset module 46 is shown. The external member 48 of the switch 16 is connected to the internal member 50 through a slot 72 of the upper casing half 28, and the first end 54 of the internal member 50 is received in a longitudinal guideway 74 of the upper casing half 28. The internal member 50 extends along the inner surface of the upper casing half 28 in the direction of the inlet apertures 32 thereof. The opposed ramp formations 70 of the upper casing half 28 are provided on the inner surface of the upper casing half adjacent the inlet apertures 32. The reset module 46 is located below the inlet apertures 32. The ramp formations 70 each comprise a plurality of inclined surfaces which define an alternating series of peaks and troughs.

Figure 11:
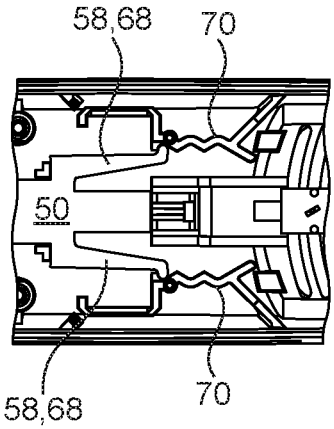
Figure 12:
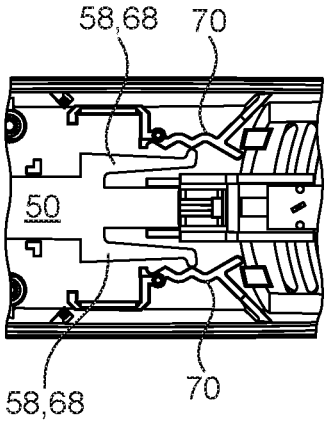
Figure 13:
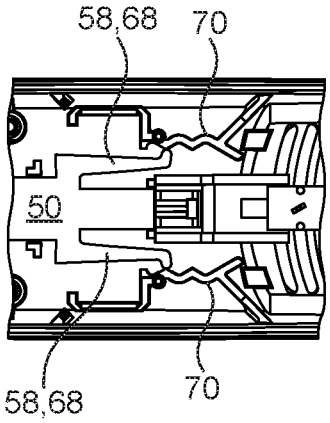

The opposed ramp formations 70 and arms 58 of internal member 50 define the off position of the switch 16 (FIG. 9), the first operating position of the switch 16 (FIG. 10) and the second operating position of the switch 16 (FIG. 11). These positions of the switch 16 are defined by opposing troughs of the ramp portions 70 into which the rounded ends 68 of the arms 58 are urged by the inherent resilience of the arms 58. Movement of the switch 16 between the off position and the first operating position, and the first operating position and the second operating position, causes the arms 58 to be deflected towards one another by opposed peaks of the ramp formations 70.

In each of the off, first and second operating positions of the switch 16 the abutment surface 60 of the internal member 50 is spaced from the actuation member 62 of the reset module 46. In the event that a reset operation is required, the user is required to move the switch 16 to a reset position such that the abutment surface 60 contacts and thereafter moves the actuation member 62 of the reset module 46. So as to prevent inadvertent operation the reset module 46, the reset position of the switch 16 is in the opposite direction from the off position to the first and second operating positions.

Figure 14:
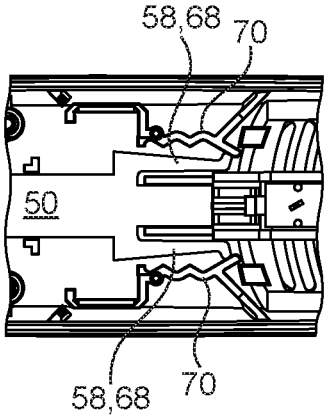
Figure 15:
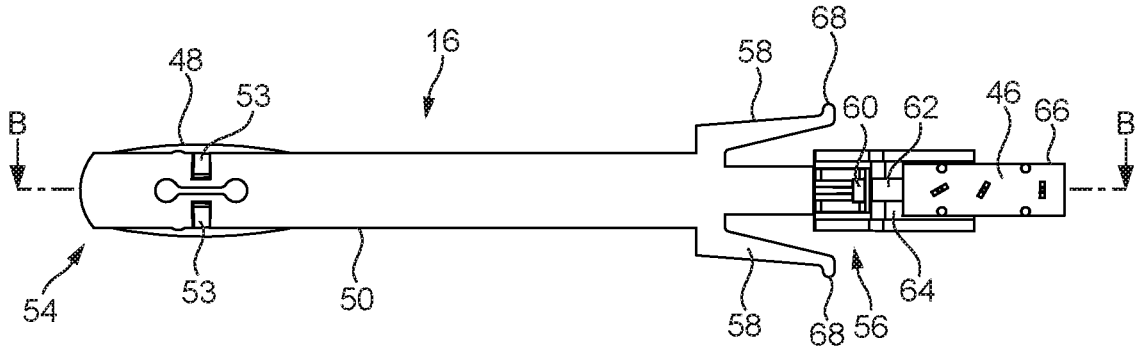
FIG. 15 shows a plan view of a switch slider of the clipper.
Figure 16:
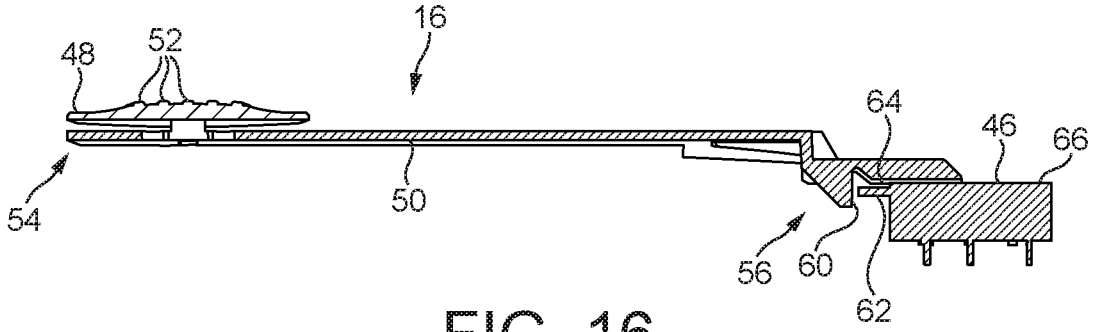
FIG. 16 shows the cross-sectional view indicated by arrows B-B on FIG. 15.
Figure 17:
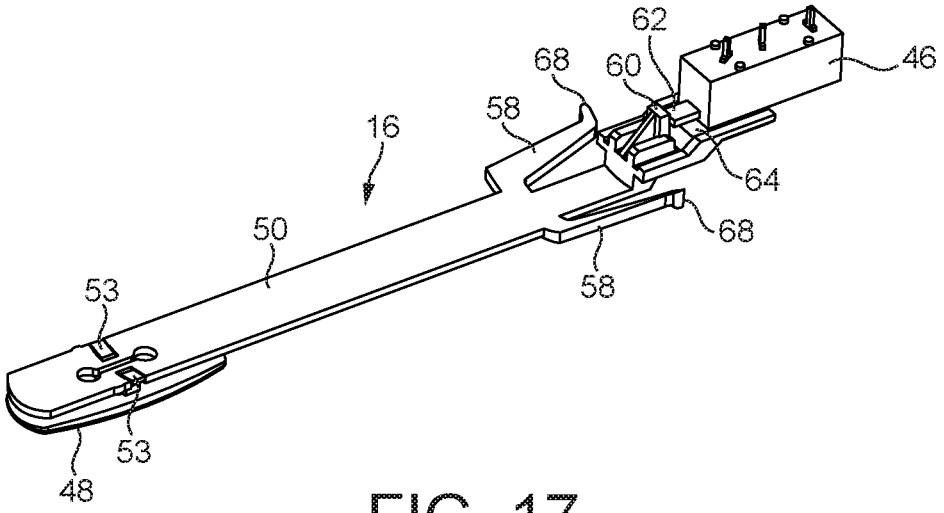
FIG. 17 shows a perspective view of the switch slider.

The detent mechanism of the switch 16 is configured such that the switch 16 is biased towards the off position from the reset position. FIG. 14 shows the position of the internal member 50 in the reset position. The abutment surface 60 is shown contacting the actuation member 62 of the reset module 46, while the arms 58 are shown compressed by the opposed ramp formations 70. Compression of the arms 58 in this manner provides a restorative force which moves the switch 16 to the off position once the user releases the switch 16.

While a particular embodiment of the present hair clipper operating switch with reset function has been described herein, it will be appreciated by those skilled in the art that changes and modifications may be made thereto without departing from the invention in its broader aspects and as set forth in the following claims.

The invention claimed is:

1. An electrically operable clipper having a body portion and a head portion, wherein the head portion includes a movable cutter and a fixed comb, the clipper including an internally located electric motor operable to move the movable cutter, wherein the clipper includes an operating switch movable between an off position, an operating position and a reset position, wherein the reset position operates a motor reset module of the clipper;

wherein the operating switch includes an internal member and an external member joined to the internal member, wherein the internal member is joined to the external member through a slot of the body portion;

wherein the external member is provided with a series of connector portions which connect the external member to the internal member; and wherein the series of connector portions comprise arms that connect to a complementarily shaped location on the internal member.

2. The electrically operable clipper as claimed in claim 1, wherein movement of the operating switch from the off position to the operating position requires movement of the switch in a first direction, and movement of the operating switch from the off position to the reset position requires movement of the switch in a second direction.

3. The electrically operable clipper as claimed in claim 2, wherein the first direction is opposite to the second direction.

4. The electrically operable clipper as claimed in claim 1, wherein the switch is movable to a further operating position, wherein the operating position corresponds to a first operating speed of the electric motor and the further operating position corresponds to a second operating speed of the electric motor.

5. The electrically operable clipper as claimed in claim 1, wherein the internal member includes a pair of resilient arms which co-operate with opposed ramp formations of the body portion.

6. The electrically operable clipper as claimed in claim 5, wherein the opposed ramp formations each comprise a plurality of inclined surfaces defining a plurality of peaks and troughs.

7. The electrically operable clipper as claimed in claim 6, wherein the off position and the operating position of the switch are defined by opposing troughs of the opposed ramp formations.

8. The electrically operable clipper as claimed in claim 5, wherein the pair of resilient arms are provided with rounded ends.

9. The electrically operable clipper as claimed in claim 5, wherein the internal member has a first end to which the external member is attached, and a second end having the pair of resilient arms.

10. The electrically operable clipper as claimed in claim 1, wherein the external member is configured such that it can be manipulated by a thumb of a user while gripping the clipper in one hand.

11. The electrically operable clipper as claimed in claim 10, wherein the external member is provided with a plurality of ridges arranged substantially transverse to the longitudinal form of the body portion.

12. The electrically operable clipper as claimed in claim 1, wherein the internal member has a length greater than a length of the external member.

13. The electrically operable clipper as claimed in claim 1, wherein the internal member is provided with a guide surface, which, in use, lies against a surface of the reset module.

14. An electrically operable clipper having a body portion and a head portion, wherein the head portion includes a movable cutter and a fixed comb, the clipper including an internally located electric motor operable to move the movable cutter, wherein the clipper includes an operating switch movable between an off position, an operating position, and a reset position, wherein the reset position operates a motor reset module of the clipper, wherein:

the operating switch includes an internal member and an external member joined to the internal member, wherein the internal member is joined to the external member through a slot of the body portion;

the internal member includes a pair of resilient arms which co-operate with opposed ramp formations of the body portion;

the opposed ramp formations each comprise a plurality of inclined surfaces defining a plurality of peaks and troughs; and in the reset position, the resilient arms are compressed between facing inclined surfaces of the opposed ramp formations such that compression of the arms provides a restorative force to urge the switch to the off position.

15. An electrically operable clipper having a body portion and a head portion, wherein the head portion includes a movable cutter and a fixed comb, the clipper including an internally located electric motor operable to move the movable cutter, wherein the clipper includes an operating switch movable between an off position, an operating position, and a reset position, wherein the reset position operates a motor reset module of the clipper, wherein an internal member of the operating switch includes a pair of resilient arms which co-operate with opposed ramp formations of the body portion and an abutment surface which contacts the motor reset module when the switch is in the reset position.

16. The electrically operable clipper as claimed in claim 15, wherein the operating switch includes an external member joined to the internal member, the internal member being joined to the external member through a slot of the body portion, further wherein the abutment surface is located between the resilient arms.

17. An electrically operable clipper having a body portion and a head portion, wherein the head portion includes a movable cutter and a fixed comb, the clipper including an internally located electric motor operable to move the movable cutter, wherein the clipper includes an operating switch movable between an off position, an operating position and a reset position, wherein the reset position operates a motor reset module of the clipper;

wherein the operating switch includes an internal member and an external member joined to the internal member, wherein the internal member is joined to the external member through a slot of the body portion; and wherein the internal member is provided with a guide surface, which, in use, lies against a surface of the reset module.

18. An electrically operable clipper having a body portion and a head portion, wherein the head portion includes a movable cutter and a fixed comb, the clipper including an internally located electric motor operable to move the movable cutter, wherein the clipper includes an operating switch movable between an off position, an operating position and a reset position, wherein the reset position operates a motor reset module of the clipper;

wherein the operating switch includes an internal member and an external member joined to the internal member, wherein the internal member is joined to the external member through a slot of the body portion;

wherein the internal member includes a pair of resilient arms which co-operate with opposed ramp formations of the body portion; and wherein the internal member has a first end to which the external member is attached, and a second end having the pair of resilient arms.

* * * * *